US011027944B2

(12) United States Patent
Bhaskar

(10) Patent No.: US 11,027,944 B2
(45) Date of Patent: Jun. 8, 2021

(54) CLIMBING ELEVATOR TRANSFER SYSTEM AND METHODS

(71) Applicant: Otis Elevator Company, Farmington, CT (US)

(72) Inventor: Kiron Bhaskar, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 324 days.

(21) Appl. No.: 15/840,578

(22) Filed: Dec. 13, 2017

(65) Prior Publication Data

US 2019/0077636 A1 Mar. 14, 2019

Related U.S. Application Data

(60) Provisional application No. 62/555,773, filed on Sep. 8, 2017.

(51) Int. Cl.
*B66B 9/00* (2006.01)
*B66B 11/04* (2006.01)

(52) U.S. Cl.
CPC ..... *B66B 9/003* (2013.01); *B66B 11/0407* (2013.01)

(58) Field of Classification Search
CPC ..... B66B 9/003; B66B 11/0407
See application file for complete search history.

(56) References Cited

U.S. PATENT DOCUMENTS 134,698 A * 1/1873 Otis ..... F16C 29/045 187/408
1,859,483 A * 5/1932 Winslow ..... B66B 9/003 198/798
3,244,258 A * 4/1966 Neidert ..... B66B 7/02 187/359
3,432,046 A * 3/1969 Krusinski ..... B65G 1/0428 414/284
3,658,155 A * 4/1972 Salter ..... B66B 9/00 198/798
3,664,523 A * 5/1972 Hagel ..... B66B 9/00 414/255

(Continued)

FOREIGN PATENT DOCUMENTS

CN 200988717 Y 12/2007
CN 101875465 A 11/2010

(Continued)

OTHER PUBLICATIONS

JPH03177290 Machine translation (1991).*

(Continued)

*Primary Examiner* — Michael A Riegelman
(74) *Attorney, Agent, or Firm* — Bachman & LaPointe, P.C.

(57) ABSTRACT

An elevator system comprising: a plurality of hoistways, each having at least one rail; at least one car moveable along and between the plurality of hoistways and having: a drive assembly operably connected to the car and including two or more wheels engageable to opposing surfaces of the rail of a hoistway along which the car may move, the drive assembly configured to apply an engagement force to the rail to both support the car at the rail and drive the car along the rail; and at least one shuttle moveable transverse to the plurality of hoistways for transferring the car between the hoistways.

18 Claims, 8 Drawing Sheets

(56) References Cited

U.S. PATENT DOCUMENTS

| | | | | |
|---|---|---|---|---|
| 3,866,767 | A * | 2/1975 | Zollinger | B65G 1/0414 414/279 |
| 5,228,820 | A * | 7/1993 | Stansfield | B65G 1/0407 414/274 |
| 5,464,072 | A * | 11/1995 | Muller | B66B 9/02 187/249 |
| 5,558,181 | A * | 9/1996 | Bundo | B66B 9/022 187/270 |
| 5,566,784 | A * | 10/1996 | Rennetaud | B66B 9/02 187/249 |
| 5,713,432 | A * | 2/1998 | Richter | B66B 7/046 187/250 |
| 5,769,183 | A * | 6/1998 | Richter | B66B 5/027 187/249 |
| 5,799,755 | A * | 9/1998 | Wan | B66B 9/003 187/403 |
| 7,537,089 | B2 * | 5/2009 | Duenser | B66B 1/2466 187/247 |
| 7,621,376 | B2 * | 11/2009 | Duenser | B66B 9/00 187/247 |
| 8,863,907 | B2 * | 10/2014 | Studer | B66B 9/022 187/270 |
| 9,248,994 | B2 * | 2/2016 | Grundmann | B66B 9/00 |
| 9,387,758 | B2 * | 7/2016 | Heinen | B60K 7/0007 |
| 9,393,859 | B2 * | 7/2016 | Heinen | B60K 7/0007 |
| 9,598,265 | B1 * | 3/2017 | Jacobs | B66B 9/003 |
| 2004/0126208 | A1 * | 7/2004 | Tawyer | H01L 21/67733 414/222.02 |
| 2006/0163008 | A1 * | 7/2006 | Godwin | B66B 9/00 187/288 |
| 2007/0084672 | A1 * | 4/2007 | Helmle | B66B 7/02 187/270 |
| 2014/0190774 | A1 * | 7/2014 | Hsu | B66B 9/003 187/406 |
| 2016/0297646 | A1 * | 10/2016 | Piech | B66B 11/04 |
| 2017/0008729 | A1 * | 1/2017 | Ginsberg | B66B 1/28 |
| 2017/0057784 | A1 * | 3/2017 | Witczak | B66B 7/02 |
| 2017/0088395 | A1 * | 3/2017 | Roberts | B66B 1/2491 |
| 2017/0088396 | A1 * | 3/2017 | Fargo | H02K 41/031 |
| 2017/0158461 | A1 * | 6/2017 | Roberts | B66B 1/30 |
| 2017/0305718 | A1 * | 10/2017 | Finschi | B66B 1/2433 |
| 2018/0009632 | A1 * | 1/2018 | Roberts | B66B 11/0407 |
| 2018/0009636 | A1 * | 1/2018 | Jedryczka | B66B 9/003 |
| 2018/0029829 | A1 * | 2/2018 | Piech | B66B 7/04 |
| 2018/0244495 | A1 * | 8/2018 | Swaybill | B66B 1/3492 |
| 2018/0257911 | A1 * | 9/2018 | Gainche | B66B 9/003 |
| 2018/0319630 | A1 * | 11/2018 | Dayrell | B66B 1/2433 |
| 2018/0362302 | A1 * | 12/2018 | Hollowell | B66B 11/007 |
| 2019/0077636 | A1 * | 3/2019 | Bhaskar | B66B 9/003 |
| 2019/0077637 | A1 * | 3/2019 | Bhaskar | B66B 11/005 |

FOREIGN PATENT DOCUMENTS

| | | | |
|---|---|---|---|
| CN | 103228563 | A | 7/2013 |
| CN | 103502133 | A | 1/2014 |
| CN | 105936459 | A | 9/2016 |
| CN | 106477406 | A | 3/2017 |
| DE | 1151908 | B | 7/1963 |
| DE | 3939762 | A1 | 6/1991 |
| JP | H03177290 | A | 8/1991 |
| JP | 05286669 | A | 11/1993 |
| KR | 20120133686 | A | 12/2012 |
| WO | 2005115906 | A2 | 12/2005 |
| WO | 2008/136692 | A2 | 11/2008 |
| WO | 2012038760 | A2 | 3/2012 |
| WO | 2012/154178 | A1 | 11/2012 |
| WO | 2015/178682 | A1 | 11/2015 |
| WO | 2016050803 | A1 | 4/2016 |
| WO | 2016/118443 | A1 | 7/2016 |
| WO | 2016/126919 | A1 | 8/2016 |
| WO | 2016203104 | A1 | 12/2016 |
| WO | 2017/027495 | A1 | 2/2017 |
| WO | 2017027503 | A1 | 2/2017 |
| WO | 2017/093595 | A1 | 6/2017 |
| WO | 2017/126963 | A1 | 7/2017 |
| WO | 2017/126965 | A1 | 7/2017 |

OTHER PUBLICATIONS

European Search Report dated Feb. 13, 2019 for European Patent Application No. 18190821.1.

"Pinch Wheel Motor Grid Rail System", Jul. 18, 2017, SGPS, Inc. (aka Show Group Production Services), Los Angeles, CA.

"ZAwheel in-wheel hub motor", archived May 20, 2017, Ziehl-Abegg Inc., Greensboro, NC, retrieved from Internet May 16, 2019 https://web.archive.org/web/20170520094636/https://www.ziehl-abegg.com/us/en/product-range/automotive/in-wheel-hub-motors/.

European Office Action dated Dec. 19, 2019 for European Patent Application No. 18190821.1.

Chinese Office Action dated Nov. 2, 2020 for Chinese Patent Application No. 201811042896.4.

* cited by examiner

CLIMBING ELEVATOR TRANSFER SYSTEM AND METHODS

CROSS-REFERENCE TO RELATED APPLICATION

Benefit is claimed of U.S. Patent Application No. 62/555,773, filed Sep. 8, 2017, and entitled "SIMPLY-SUPPORTED RECIRCULATING ELEVATOR SYSTEM", the disclosure of which is incorporated by reference herein in its entirety as if set forth at length.

BACKGROUND

The disclosure relates to elevator systems. More particularly, the disclosure relates to ropeless elevators wherein the elevator cars are propelled by onboard motors.

PCT/US2011/036020 of Shu et al., internationally filed May 11, 2011 and entitled "Circulation Transport System" discloses a ropeless elevator system (also known as self-propelled elevator system) with horizontal transfer between hoistways. International Application No. PCT/US2016/046120 of Witczak et al., internationally filed Aug. 9, 2016, and entitled "Configurable Multicar Elevator System" discloses another exemplary ropeless elevator system. US Patent Application Publication 2017/0088395A1 of Roberts et al., filed Sep. 23, 2016 and published Mar. 30, 2017 discloses another ropeless elevator system.

In the distinct automotive propulsion field, wheel hub motors have been developed for electric automobiles. A recent example of a wheel hub motor (also known as in-wheel electric motor) is found in PCT/NL2017/050032, internationally filed Jan. 19, 2017 and entitled "Wheel Comprising an In-Wheel Electric Motor", published Jul. 27, 2017 as WO2017/126963A1. The disclosure of WO2017/126963A1 (the WO '963 publication) is incorporated by reference herein in its entirety as if set forth at length

SUMMARY

One aspect of the disclosure involves an elevator system comprising a plurality of hoistways, each having at least one rail. At least one car is moveable along and between the plurality of hoistways and has a drive assembly operably connected to the car and including two or more wheels engageable to opposing surfaces of the rail of a hoistway along which the car may move. The drive assembly is configured to apply an engagement force to the rail to both support the car at the rail and drive the car along the rail. At least one shuttle is moveable transverse to the plurality of hoistways for transferring the car between the hoistways.

In one or more embodiments of any of the foregoing embodiments, the drive assembly comprises, for at least a first wheel and a second wheel of said two or more wheels, a wheel hub motor.

In one or more embodiments of any of the foregoing embodiments, each said wheel comprises a tire mounted to rotate with a rotor of the wheel hub motor.

In one or more embodiments of any of the foregoing embodiments, each hoistway has a first said rail and a second said rail. Each said car has at least: a first pair of wheels oppositely engaged to the first rail and comprising said first wheel and a third wheel; and a second pair of wheels oppositely engaged to the second rail and comprising said second wheel and a fourth wheel.

In one or more embodiments of any of the foregoing embodiments, the system further comprises at least one device for compressing the first pair of wheels to the first rail and the second pair of wheels to the second rail.

In one or more embodiments of any of the foregoing embodiments, at least one of the at least one shuttle comprises at least one rail positionable in registry with the rail of one of the hoistways to receive a car from or transfer a car to that hoistway.

In one or more embodiments of any of the foregoing embodiments, the system further comprises a transfer rail, at least one of the at least one shuttle being configured to suspend a car from the transfer rail for movement between the hoistways.

In one or more embodiments of any of the foregoing embodiments, the shuttle comprises a wheel hub motor to drive the shuttle along the transfer rail.

In one or more embodiments of any of the foregoing embodiments, the system further comprises a track, at least one of the at least one shuttle being supported atop the track.

In one or more embodiments of any of the foregoing embodiments, the at least one shuttle comprises: a first shuttle at a first level; and a second shuttle at a second level different from the first level.

In one or more embodiments of any of the foregoing embodiments, for each hoistway, the at least one rail comprises a first rail and a second rail.

In one or more embodiments of any of the foregoing embodiments, the car has doors only on one side.

In one or more embodiments of any of the foregoing embodiments, each hoistway has an electrical contact rail and the car has at least one electrical contact shoe for engaging the electrical contact rail for powering the car.

In one or more embodiments of any of the foregoing embodiments, a method for using the system comprises: driving the car along a first of the hoistways; acquiring the car by the shuttle; moving the shuttle transverse to the hoistways to align the car with a second of the hoistways; and driving the car along the second hoistway.

In one or more embodiments of any of the foregoing embodiments, the second hoistway comprises a dedicated car maintenance location and the driving along the second hoistway comprises driving to the dedicated maintenance location.

In one or more embodiments of any of the foregoing embodiments, the acquiring comprises driving the car so that its wheels disengage the opposing surfaces of the rail of the first hoistway and engage opposing surfaces of a rail of the shuttle.

Another aspect of the disclosure involves an elevator system comprising: a first hoistway; a second hoistway; a guide rail including: a first guide rail portion extending along the first hoistway; and a second guide rail portion extending along the second hoistway. A transfer rail spans the first hoistway and second hoistway and supports a transfer carriage. An elevator car is disposed in and movable along the guide rail; and a drive assembly operably connected to the elevator car and including two or more wheels engaged to opposing surfaces of the rail, the drive assembly configured to apply an engagement force to the rail to both support the elevator car at the rail and drive the elevator car along the rail. The elevator car and the drive assembly are configured to allow for travel of the elevator car in a vertical position along the first guide rail portion, and to transfer from the first hoistway to the second hoistway via the transfer carriage.

In one or more embodiments of any of the foregoing embodiments, the transfer carriage includes a direct drive prime mover to move the transfer carriage along the transfer rail.

In one or more embodiments of any of the foregoing embodiments, the direct drive prime mover is a wheel hub motor.

In one or more embodiments of any of the foregoing embodiments, the two or more wheels engage the rail via an engagement force applied by one or more of a spring element, or a mechanical, electrical or hydraulic actuator.

In one or more embodiments of any of the foregoing embodiments, the rail includes a rail web connected to rail flanges, the wheels disposed on opposing sides of the rail web.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
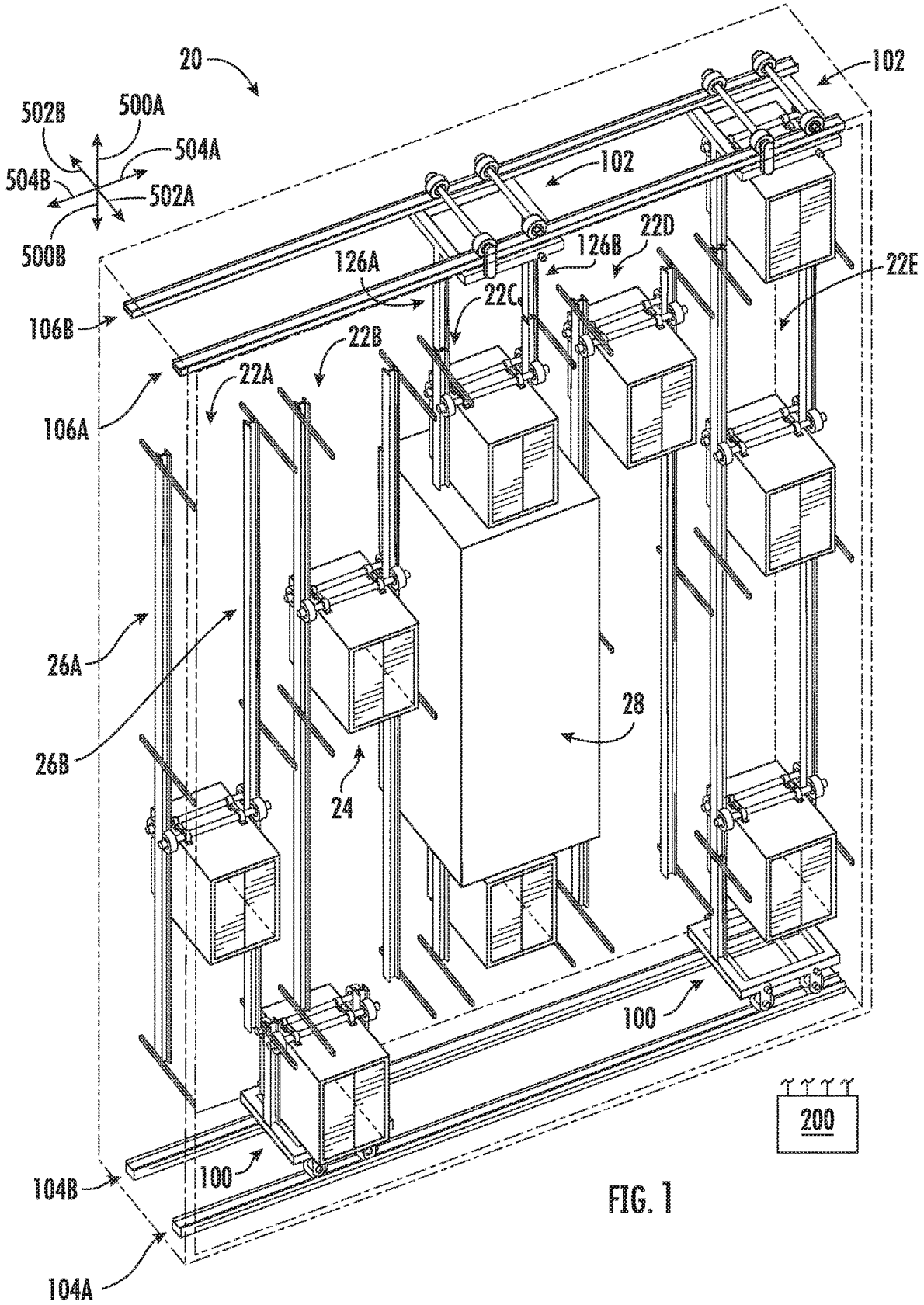
FIG. 1 is a front oblique schematic view of an elevator system.
Figure 2:
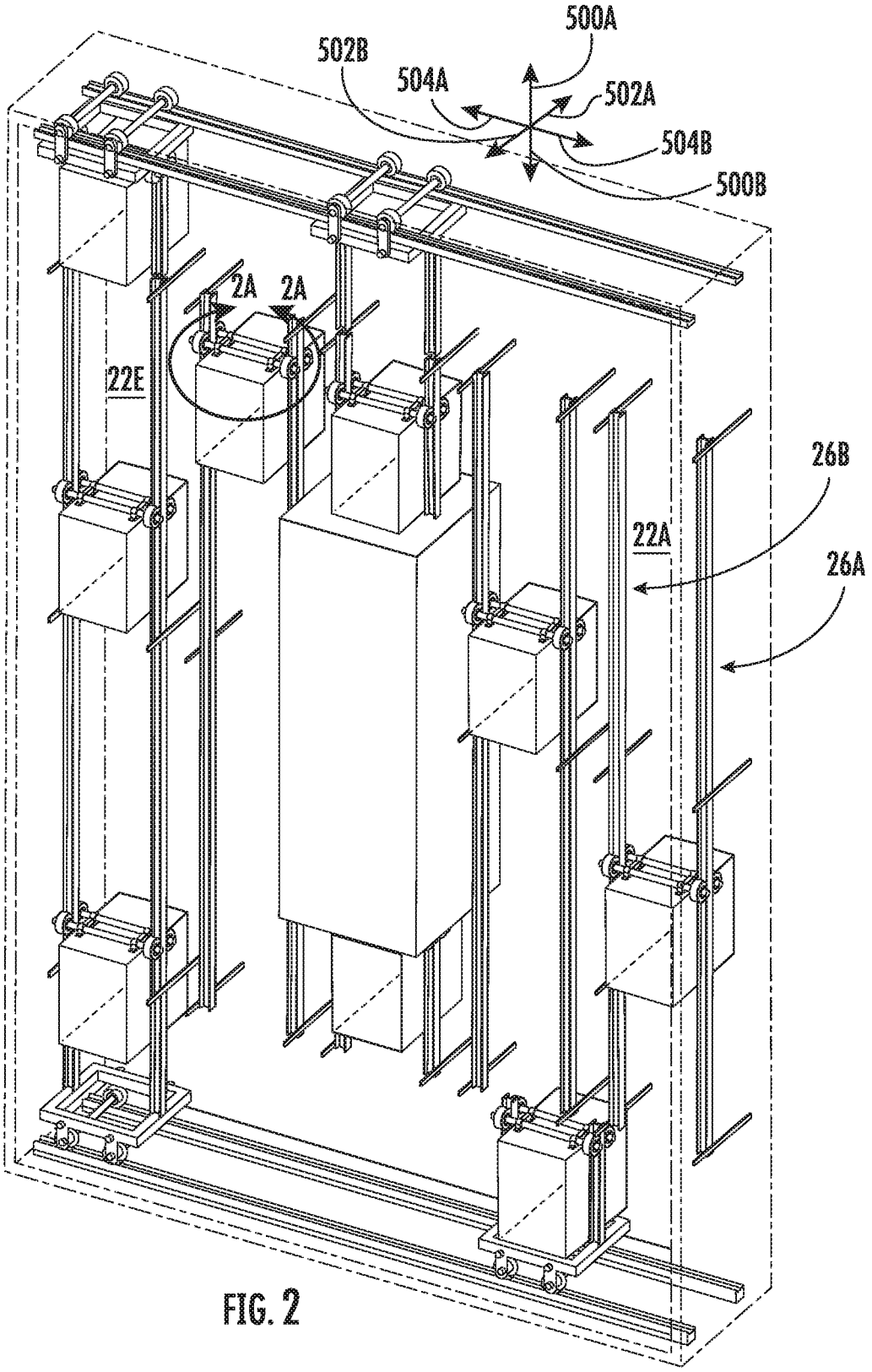
FIG. 2 is a rear oblique schematic view of the elevator system.

FIG. 1 shows an elevator system 20 having a group or cluster of hoistways 22A, 22B, 22C, 22D, 22E. The hoistways may each span multiple floors of a building. The elevator system further includes a plurality of elevator cars 24 movable along and among the hoistways as is discussed below. The exemplary cars are single-door cars (i.e., door(s) at only one end of the car which is defined as a front of the car—the rear end (FIG. 2) being closed). In other embodiments, the cars may have any desired configuration of doors. Thus, a forward direction is shown as 502A, an aft direction as 502B, an upward direction as 500A, a downward direction 500B, and opposite first and second lateral directions as 504A and 504B.

Figure 3:
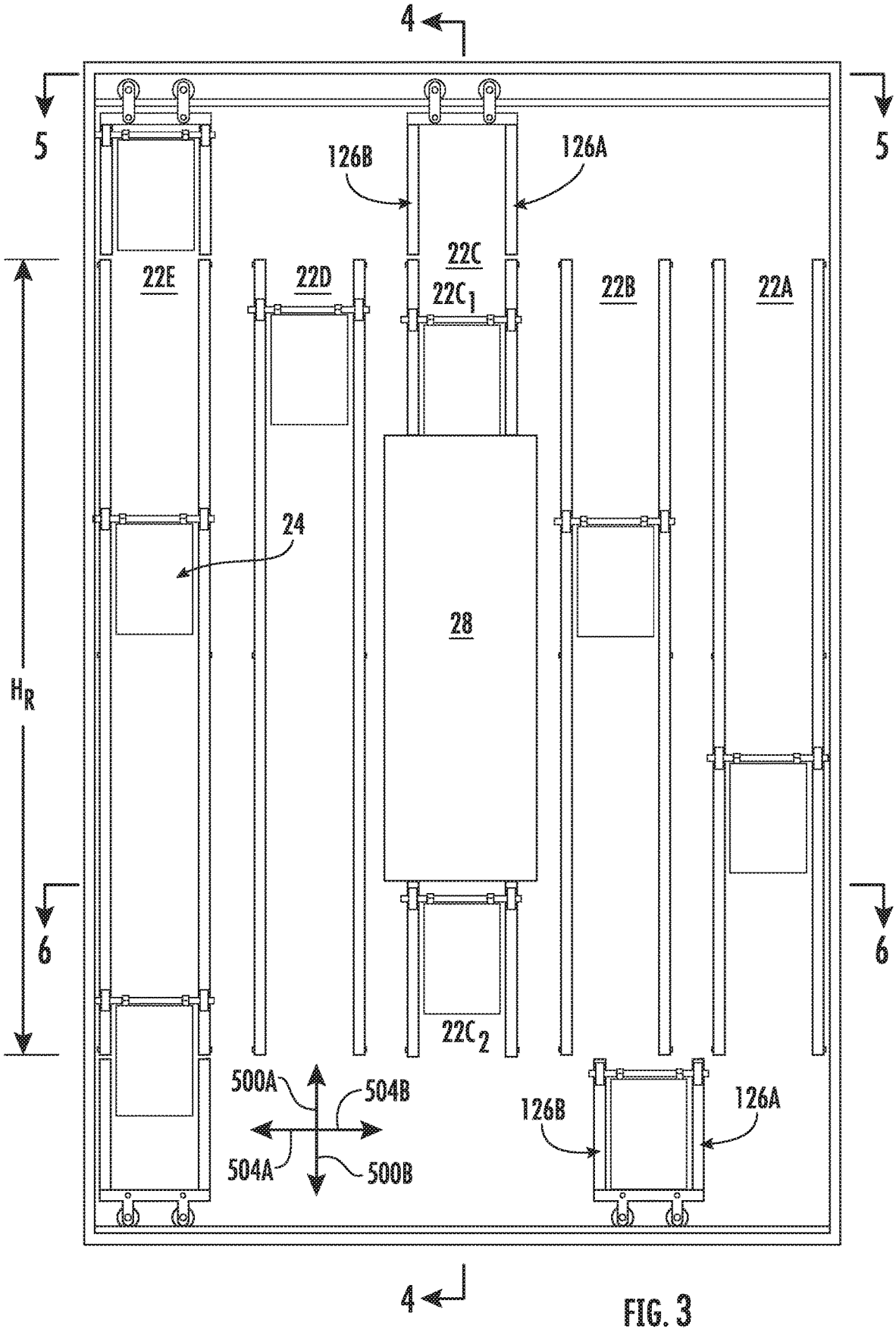
FIG. 3 is an aft view of the elevator system.

Each hoistway includes a pair of vertical rails 26A, 26B (e.g., steel). For at least some of the hoistways, the rails extend along a height $H_R$ (FIG. 3). The height $H_R$ may span multiple floors of the building. In the exemplary embodiment, for each of the hoistways 22A, 22B, 22D, and 22E, $H_R$ is the same and continuous and even (starts and ends at same level). In other embodiments, $H_R$ may be different for some of the hoistways 22A, 22B, 22D, and 22E. The exemplary hoistway 22C is segmented with an upper portion 22$C_1$ and a lower portion 22$C_2$ (FIG. 3) respectively above and below a vacant space 28 which may form part of the occupied space of the building.

Other more complex embodiments may do things such as have different heights $H_R$ and/or stagger the heights. For example, different or staggered heights may serve various purposes such as providing a limited number of elevators with access to upper floors while not wasting the space of extending all the hoistways to said upper floors. Similarly, at the bottom end, there may be a limited service to parking garages, basements, and the like. Yet further variations can come into play when dealing with transfer situations such as where passengers take one set of elevators up through a lower portion of a building and then transfer to another set. However, as is discussed below, one advantage of some implementations may be avoiding the need for transfer between cars.

As is discussed further below, the cars 24 are self-propelled. This frees the elevator design from constraints of rope systems. Such constraints include height limitations and the association of specific cars with specific corresponding hoistways. Also, ropeless systems are less sensitive to building sway (e.g., wind or seismic). Also, during large seismic events, roped systems may have problems with ropes coming off pulleys and with damage to relatively light duty stabilizing rollers.

Figure 6:
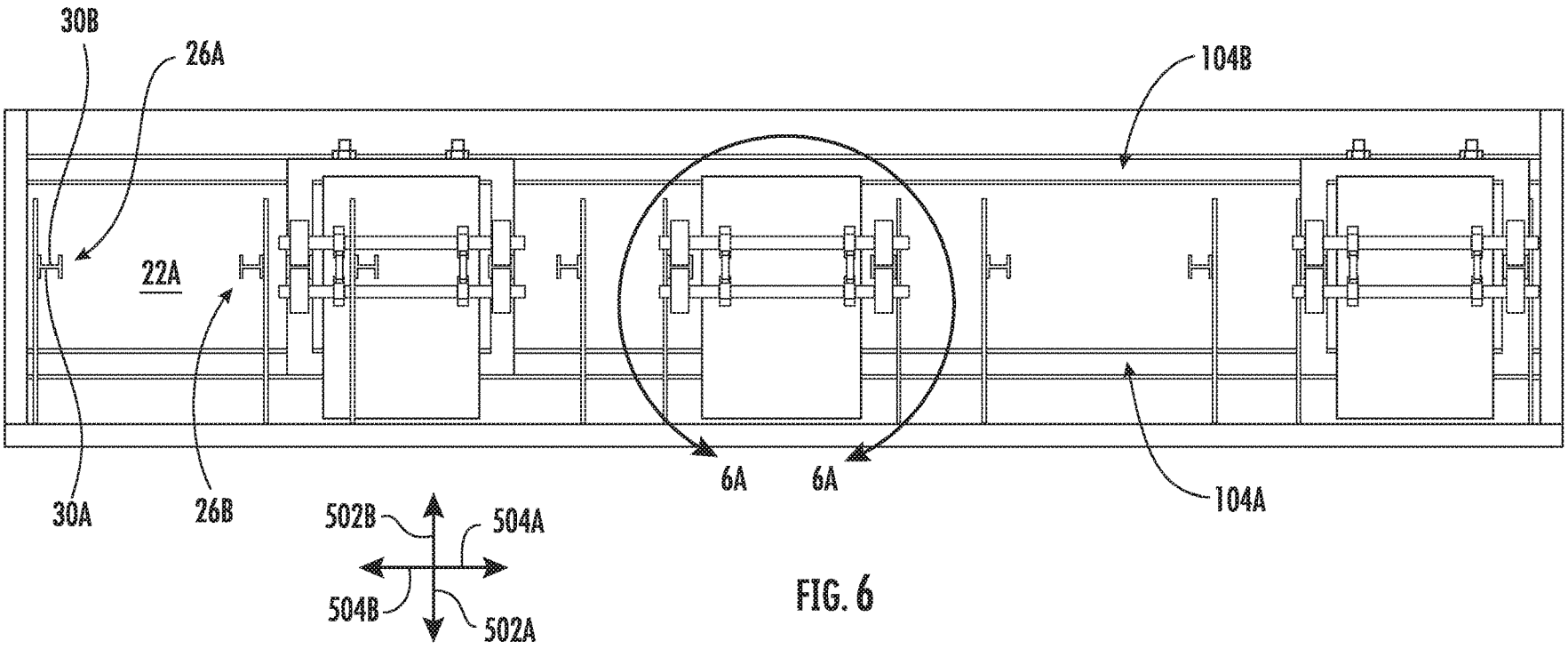
FIG. 6 is a downward sectional view taken along line 6-6 of FIG. 3.

FIG. 6 shows each rail 26A, 26B as having front face 30A and an aft face 30B. The exemplary front and aft faces are front and aft faces of a web of an I-beam that, accordingly, has respective inboard and outboard flanges at opposite ends of the web cross-section. Alternate rails may be T-sectioned or may be box-sectioned (hollow).

Figure 2A:
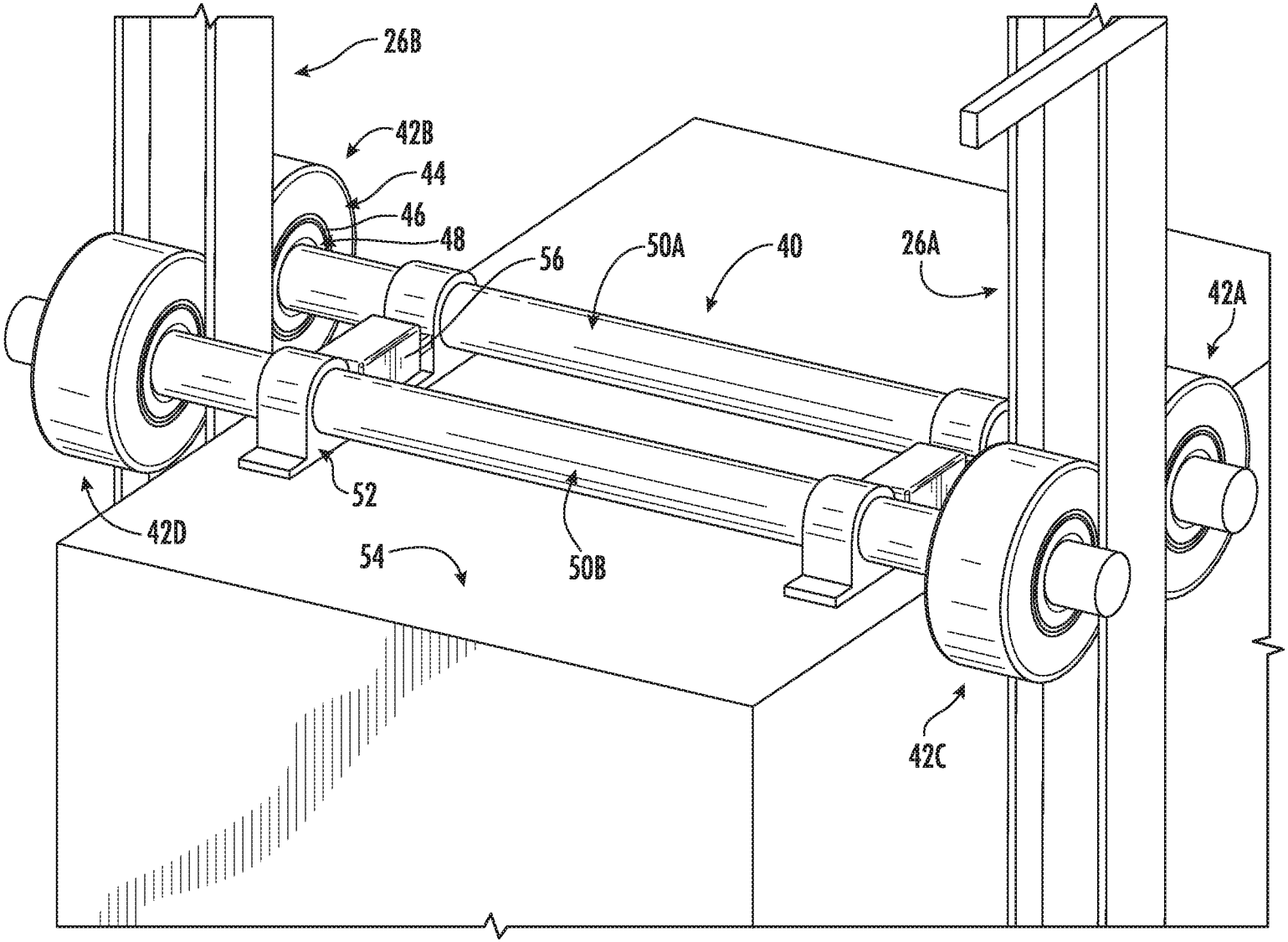
FIG. 2A is an enlarged view of an upper portion of a car in the elevator system of FIG. 2.

Each car includes a drive assembly 40 (FIG. 2A) operably connected to the car and including two or more wheels (wheel assemblies) engagable to the faces 30A and 30B to apply an engagement force to the rails to both support the car at the rails and drive the car along the rails. In the exemplary embodiment, there are four wheels: a forward pair of wheels 42A, 42B; and an aft pair of wheels 42C and 42D (collectively or individually 42). The exemplary wheels 42 each comprise a tire 44, a rim/wheel 46, and a wheel hub motor 48. In various embodiment, the wheels 42 may have friction surface such as a tire mounted directly to or integral with the wheel hub motor 48. The first wheels 42A, 42C of each pair engage the first rail 26A of the hoistway and the second wheels 42B, 42D engage the second rail 42B. Alternatively characterized, the wheels 42A and 42C may form a first pair engaging opposite faces of the first rail, while the wheels 42B and 42D form a second pair engaging opposite faces of the second rail.

In the exemplary embodiment, all four wheels 42 have direct drive prime movers in the form of wheel hub motors 48. Alternative embodiments may include motors in only two (e.g., the front wheels 42A, 42B or the back wheels 42C, 42D with the undriven wheels merely serving to stabilize and pinch the rail between the wheels). The exemplary FIG. 2A configuration shows the front pair of wheels mounted to a shaft 50A and the aft pair mounted to a shaft 50B.

The exemplary shafts 50A, 50B are non-rotating shafts providing structural support rather than serving as axles. The exemplary shafts are secured against rotation in pillow blocks 52 so that the stator of the wheel hub motor is rigidly non-rotatably connected to the associated shaft. The rotor of the wheel hub motor is connected to (e.g., integrated with) the rim 48.

The exemplary pillow blocks 52 are shown mounted to the top 54 of the car. In one implementation, the pillow blocks are slidably mounted fore and aft along a limited range of movement and a tensioning device 56 links adjacent pillow blocks of the fore and aft shafts to each other to apply tension and, in turn, compress the rail between the associated wheels to provide sufficient normal force to avoid slippage. The tensioning device 56 may comprise a spring, a hydraulic actuator, a pneumatic actuator, or the like. When the tensioning device is a controllable actuator, additional safety mechanisms may be provided such as mechanical locking. For example, the tensioning device may initially tension and compress the wheels against the rail but then be locked out.

In other variations, one of the two pillow blocks in each pair (e.g., both pillow blocks of one of the two shafts) are fixed and the other is slidably mounted. Other variations may avoid the wheel hub motors. For example, the shafts may be rotatably mounted to the car with the pillow blocks as bearings. One or both shafts may be integrated with or otherwise driven by the inner rotor of an electric motor (e.g., with the outer stator fixed against rotation)).

Exemplary tires include solid rubber or other resilient material or pneumatic tires.

Figure 4:
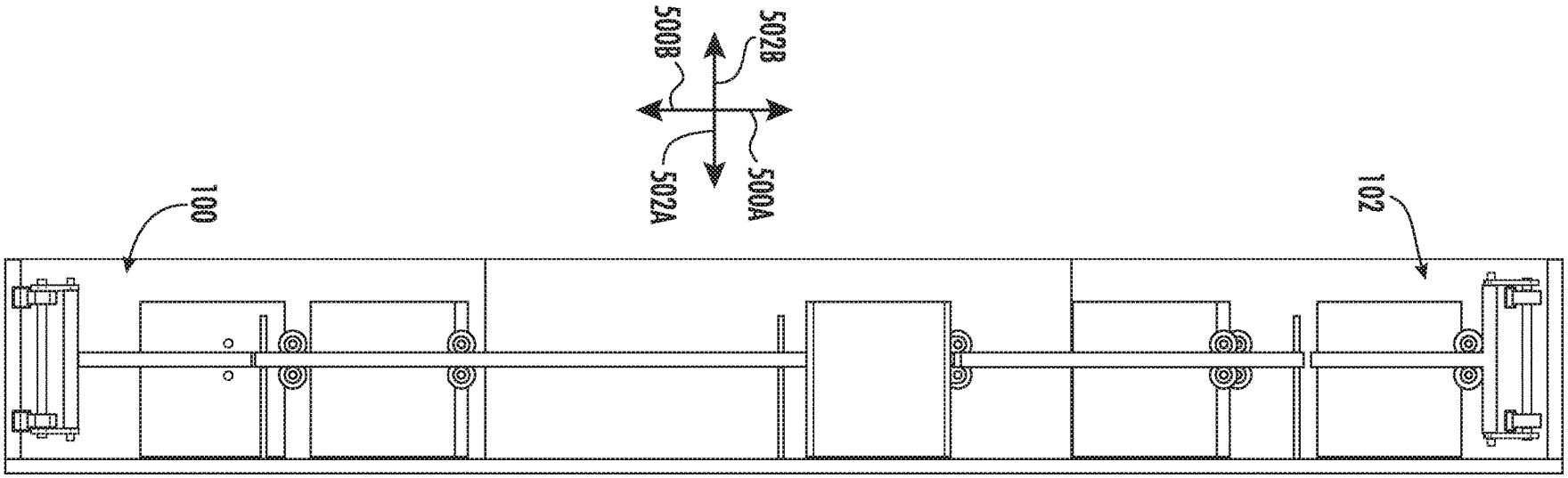
FIG. 4 is a longitudinal vertical sectional view of the elevator system taken along line 4-4 of FIG. 3.
Figure 5:
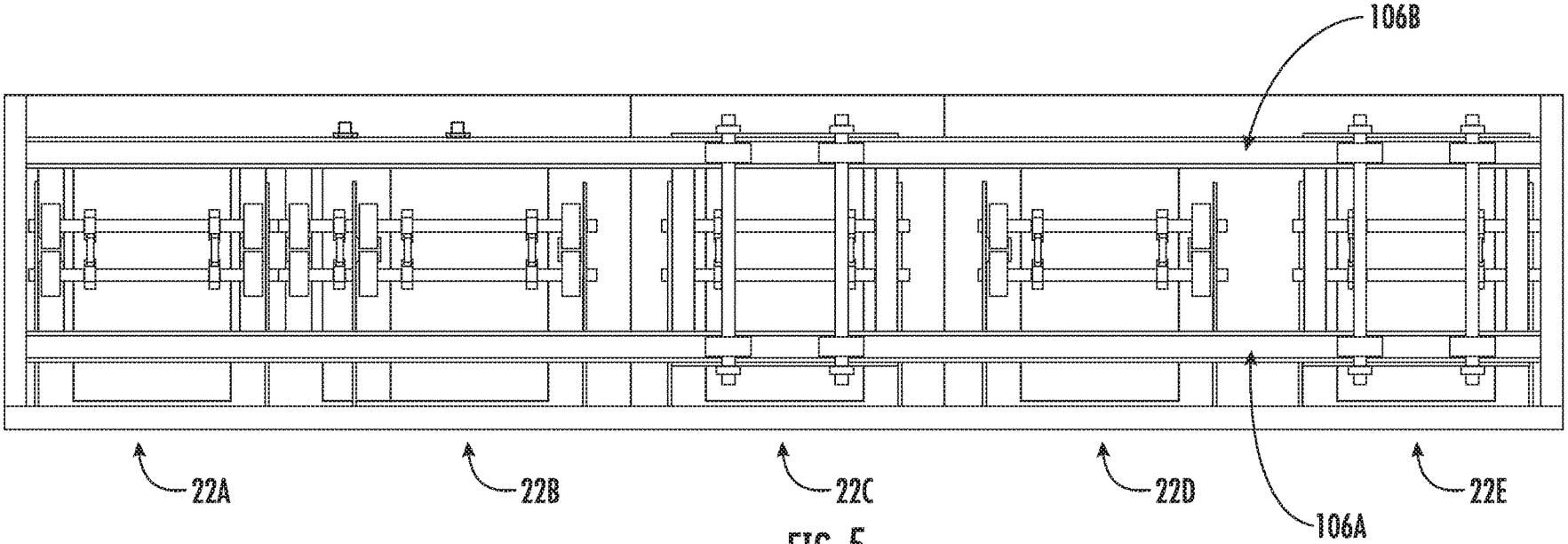
FIG. 5 is a downward sectional view of the elevator system taken along line 5-5 of FIG. 3.

The cars may further be movable among/between the hoistways. This may be accomplished by transfer shuttles or carriages 100, 102. FIGS. 1 and 4 show one or more lower transfer shuttles 100 as carts 100 at the bottom of the cluster for transferring cars between hoistways. FIG. 1 also shows upper transfer shuttles 102 as hanging shuttles 102 at the top of the cluster for transferring cars between hoistways. The exemplary carts 100 are wheeled carts riding along a pair of rails 104A, 104B. The exemplary hanging shuttles 102 are also wheeled, having wheels riding atop rails 106A, 106B (FIGS. 1 and 5). Thus, the rails 104A, 104B and 106A, 106B form tracks (e.g., shown as box channel tracks). The carts 100 and hanging shuttles 102 may be driven by onboard motors or otherwise controlled (e.g., chain or similar drive). Exemplary onboard motors include hub motors such as those described for the wheels 42.

The transfer shuttles 100, 102 each have a pair of vertical rails 126A, 126B. When a shuttle is in an operative position registered with a given hoistway, these rails align/register with the rails 26A, 26B of the hoistway to allow a car to drive between the hoistway rails and the shuttle rails. Accordingly, the cross-section and spacing of the shuttle rails may be the same as that of the hoistway rails. Once a car has fully transferred to a transfer shuttle, the shuttle may move the car from one hoistway to another and then the car may drive itself off the rails of the shuttle and onto the rails of that hoistway, thereby freeing the shuttle for further use.

Although the exemplary system shows multiple hanging shuttles 102 and multiple carts 100, there need not be multiples of each and need not be both types. Additionally, although the transfer shuttle tracks are shown as laterally coextensive with the hoistways, there could be different configurations in which one or both of the sets of transfer shuttle tracks extend laterally past the hoistways or do not extend fully across. As noted above, for example, in a high rise building, it might be possible that there are multiple groups of one or both types of transfer shuttle. For example, the full number of hoistways may extend along the lower portion of the building and a subgroup may extend the full height. There thus could be one set of transfer shuttle tracks and hanging shuttle(s) 102 at the very top covering just the full-height subgroup while another is at the top of the shorter height subgroup that spans just that subgroup.

As noted above, the exemplary illustrated configuration shows four full-height hoistways 22A, 22B, 22D, and 22E. The hoistway 22C is vertically interrupted. The portions of that hoistway beyond the vacant space (dead area) 28 may service a smaller group of floors or may act as locations for purposes such as car maintenance, car storage, and the like. The exemplary embodiment shows one such location above the dead space and one such location below the dead space merely for purposes of illustration.

Although not illustrated, the hoistways may be isolated from each other via walls such as for fire protection or structural purposes. For example, the walls may be load bearing and the rails may be mounted to the walls. Alternatively, the rails may be supported front and back via beams extending to front and back walls of the building structure surrounding the cluster.

The elevators may be powered via conductors (discussed below) running along the shaft and engaged by appropriate conductors (e.g., shoes) on the car. One set of possibilities involves embedding the former conductors along the rails. Communication may similarly pass through conductors or may be radio frequency via transmit/receive radios (not shown) in each car communicating with one or more radios (not shown) in the hoistway which, in turn, may be hard wire or radio connected to a central controller 200 (FIG. 1) that interfaces with the cars' local controllers 204, the building's control devices (e.g., the elevator buttons and central control console), and the like. The transfer shuttles 100, 102 may be similarly powered and controlled.

Figure 6A:
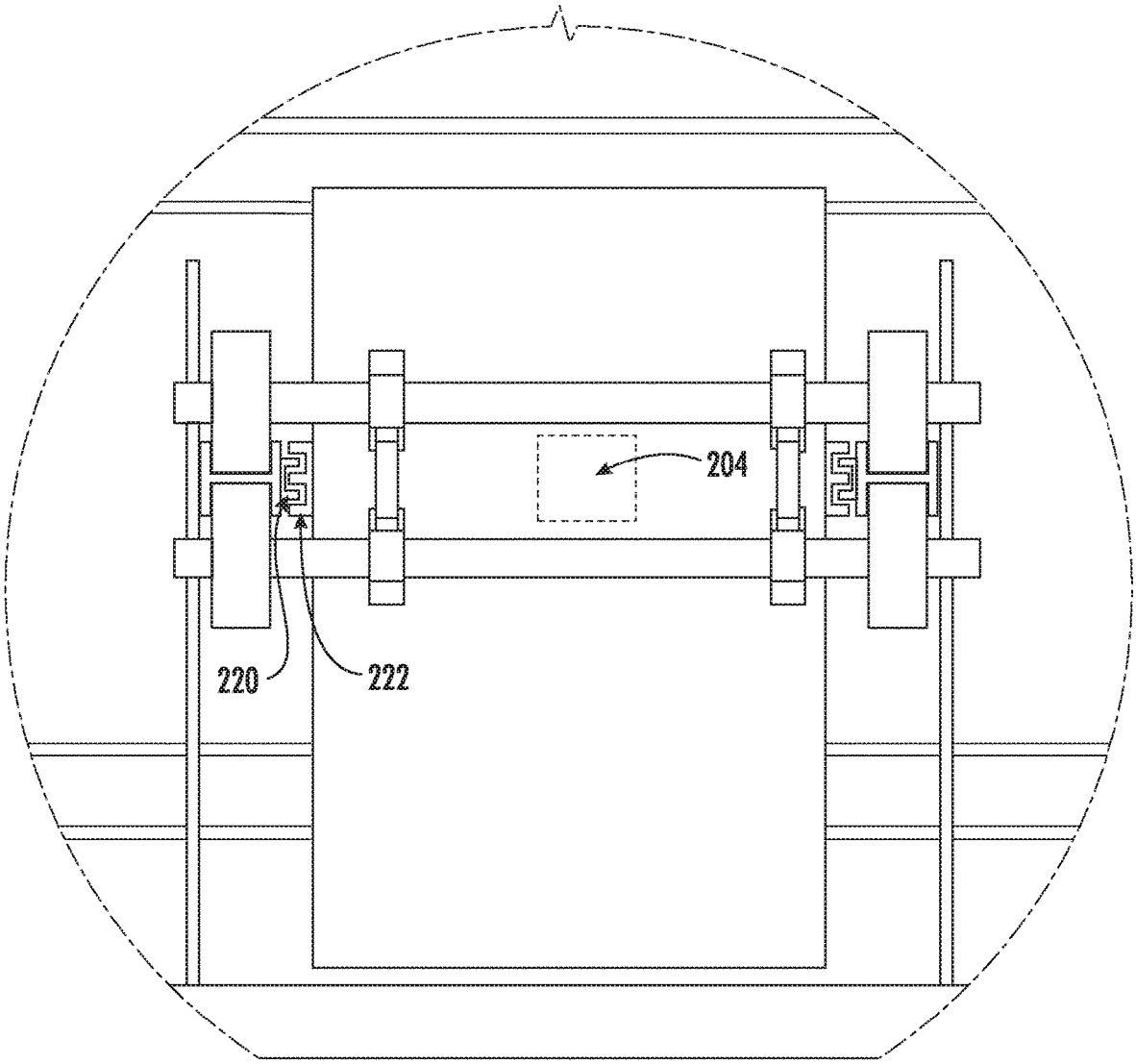
FIG. 6A is an enlarged view of an electric shoe/rail area of the upper portion of a car in the elevator system of FIG. 6.

Examples of such powering may be via a power rail 220 (FIG. 6A) integrated with or parallel to one or both rails (and tracks for the transfer shuttles). Multipole conductor rails 220 are available from suppliers in the industrial crane and warehousing fields such as Conductix-Wampfler USA, Omaha, Nebr. The multipole rail allows one or more forms of power (e.g., one form for powering the motors and another form for powering lighting, control, communications, climate control, etc.) and control and communication. The cars and transfer shuttles have contact shoes 222 complementary to the power rails.

The transfer shuttle vertical rails may have power (and communication/control) rails 220 just as the hoistway rails. These may receive power and communication/control via the transfer shuttle track power and communication/control rails 220 and transfer shuttle shoes 222.

Also, there may be a local battery (charged via the rail power) in each car and shuttle to provide emergency operation and continuous operation despite interruptions (e.g., a loss of electrical contact at some particular location in car travel).

FIG. 1 further shows the central controller 200. As noted above, there may be a combination of a central (main or group) controller 200 and local controllers 204 (FIG. 6A) on each car and transfer shuttle. The central controller may receive user inputs from an input device (e.g., switches, keyboard, or the like) and sensors (not shown, e.g., car position sensors, door position sensors, motor condition sensors, power sensors, and temperature sensors at various system locations). The controller may be coupled to the sensors and controllable system components (e.g., transfer shuttle motors, car motors, locking mechanisms, and the like) via control lines 202 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The system may be implemented using existing or yet-developed self-propelled/ropeless elevator technology. As such, materials and manufacture techniques may be drawn from such technologies. As mentioned above, use of a hub motor and rail systems is one particular implementation.

Thus, use of the same hub motors in the transfer shuttles 100, 102 as in the cars 24 is an option that facilitates economy of scale in manufacture and repair. However, alternatives are possible. Although shown with two pairs of wheels pinching two rails, other self-propelled configurations are relevant including situations where the wheels might be outwardly biased (e.g., against four respective rails or other surfaces along the periphery of the individual hoistway).

Additional features may relate to the cars going to transfer stations. For example, when a car is otherwise to go to a transfer station, there may be a passenger detection override that prevents the car from leaving the main portion of a hoistway until all passengers have left (but optionally with a service or emergency override allowing technicians or emergency personnel to ride the car into engagement with the transfer shuttle, etc.).

Control may generally correspond to that set forth in United States Patent Application Publication 20170008729A1, of Ginsberg, et al., Jan. 12, 2017, the disclosure of which in incorporated by reference in its entirety herein as if set forth at length, and International Application No. PCT/US2016/016528, internationally filed Feb. 4, 2016, and entitled "Multi-Car Elevator Control", published Aug. 11, 2016 as WO2016/126919A1 (the '919 publication) the disclosure of which is incorporated by reference in its entirety herein as if set forth at length.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. An elevator system comprising:

a plurality of hoistways, each having at least one rail;

at least one car moveable along and between the plurality of hoistways and each car of the at least one car having:

a drive assembly including:

two or more wheels engageable to opposing surfaces of the rail of a hoistway of the plurality of hoistways along which the car may move, the drive assembly configured to apply an engagement force to the rail to both support the car at the rail and drive the car along the rail; and for at least a first wheel and a second wheel of said two or more wheels, a wheel hub motor, each said wheel hub motor comprising:

a rotor connected to a rim of the respective first wheel and second wheel; and a stator nonrotatably connected to a shaft; and at least one shuttle moveable transverse to the plurality of hoistways for transferring the at least one car between the hoistways, wherein:

said at least one shuttle comprises at least one rail positionable in registry with the rail of one of the hoistways to receive a car from or transfer a car to that hoistway and to suspend said car for movement between that hoistway and another of the hoistways.

2. The system of claim 1 wherein:

each said wheel comprises a tire mounted to the respective rim rotate with the rotor of the wheel hub motor.

3. The system of claim 1 wherein:

each hoistway has a first said rail and a second said rail;

each said car has at least:

a first pair of wheels oppositely engaged to the first rail and comprising said first wheel and a third wheel; and a second pair of wheels oppositely engaged to the second rail and comprising said second wheel and a fourth wheel.

4. The system of claim 3 further comprising:

at least one device for compressing the first pair of wheels to the first rail and the second pair of wheels to the second rail.

5. The system of claim 1 further comprising:

a transfer rail, at least one of the at least one shuttle being configured to suspend a car from the transfer rail for movement between the hoistways.

6. The system of claim 5 wherein the shuttle comprises a wheel hub motor to drive the shuttle along the transfer rail, the shuttle wheel hub motor comprising:

a rotor connected to a rim of a wheel of the shuttle, and a stator nonrotatably connected to a shaft.

7. The elevator system of claim 5, wherein:.

the transfer rail is a pair of transfer rails;

the shuttle has respective wheels engaging the rails of the pair of transfer rails;

the at least one rail of the shuttle is a pair of shuttle rails depending below the transfer rails.

8. The system of claim 1 further comprising:

a track, at least one of the at least one shuttle being supported atop the track.

9. The system of claim 1 wherein:

the at least one shuttle comprises:

a first shuttle at a first level; and a second shuttle at a second level different from the first level.

10. The system of claim 1 wherein:

for each hoistway, the at least one rail comprises a first rail and a second rail.

11. The system of claim 1 wherein:

the car has doors only on one side.

12. A method for using the system of claim 1, the method comprising:

driving the car along a first of the hoistways;

acquiring the car by the shuttle;

moving the shuttle transverse to the hoistways to align the car with a second of the hoistways; and driving the car along the second hoistway.

13. The method of claim 12 wherein the second hoistway comprises a dedicated car maintenance location and the driving along the second hoistway comprises driving to the dedicated maintenance location.

14. The method of claim 12 wherein:

the acquiring comprises driving the car so that its wheels disengage the opposing surfaces of the rail of the first hoistway and engage opposing surfaces of a rail of the shuttle.

15. An elevator system comprising:

a plurality of hoistways, each having at least one rail;

at least one car moveable along and between the plurality of hoistways and having:

a drive assembly:

operably connected to the car;

including two or more wheels engageable to opposing surfaces of the rail of a hoistway along which the car may move;

configured to apply an engagement force to the rail to both support the car at the rail and drive the car along the rail; and comprising for at least a first wheel and a second wheel of said two or more wheels, a wheel hub motor within a rim of the respective first wheel and second wheel; and at least one shuttle moveable transverse to the plurality of hoistways for transferring the car between the hoistways, wherein:

each hoistway of the plurality of hoistways has an electrical contact rail; and the at least one car has at least one electrical contact shoe for engaging the electrical contact rail for powering the car.

16. An elevator system comprising:

a first hoistway;

a second hoistway;

a guide rail including:

a first guide rail portion extending along the first hoistway;

a second guide rail portion extending along the second hoistway; and a transfer rail spanning the first hoistway and the second hoistway and supporting a transfer, carriage wherein;

the transfer carriage has one or more wheels engaging the transfer rail;

the transfer carriage has a transfer carriage rail depending below the transfer rail;

the transfer carriage includes a direct drive prime mover to move the transfer carriage along the transfer rail; and the direct drive prime mover is a wheel hub motor having a rotor surrounding a stator, an elevator car movable along the first guide rail and second guide rail and the transfer carriage rail; and a drive assembly operably connected to the elevator car and including two or more wheels engaged to opposing surfaces of an engaged rail of the first guide rail, the second guide rail, and the transfer carriage rail, the drive assembly configured to apply an engagement force to the engaged rail to both support the elevator car at the engaged rail and drive the elevator car along the engaged rail;

wherein the elevator car and the drive assembly are configured to allow for travel of the elevator car in a vertical position along the first guide rail portion, and to transfer from the first hoistway to the second hoistway via the transfer carriage.

17. The elevator system of claim 16, wherein the two or more wheels engage the rail via an engagement force applied by one or more of a spring element, or a mechanical, electrical or hydraulic actuator.

18. The elevator system of claim 16, wherein the rail includes a rail web connected to rail flanges, the wheels disposed on opposing sides of the rail web.

* * * * *